US005329072A

United States Patent [19]

Kageyama et al.

[11] Patent Number: 5,329,072

[45] Date of Patent: Jul. 12, 1994

[54] ACOUSTIC DIAPHRAGM

[75] Inventors: Tomoyuki Kageyama; Kunio Suzuki, both of Hamamatsu, Japan

[73] Assignee: Yamaha Corporation, Hamamatsu, Japan

[21] Appl. No.: 888,546

[22] Filed: May 22, 1992

[30] Foreign Application Priority Data

May 23, 1991 [JP] Japan ..... 3-118900
May 23, 1991 [JP] Japan ..... 3-118901
May 24, 1991 [JP] Japan ..... 3-120472

[51] Int. Cl.[5] ..... G10K 13/00
[52] U.S. Cl. ..... 181/167; 181/169
[58] Field of Search ..... 181/167, 169, 170; 428/225, 288, 257, 258, 259

[56] References Cited

U.S. PATENT DOCUMENTS 1,790,679 2/1931 Seely ..... 181/169
4,699,242 10/1987 Ono ..... 181/167 X
5,031,720 7/1991 Ohta et al. ..... 181/169

FOREIGN PATENT DOCUMENTS 61-157100 7/1986 Japan .
62-107599 5/1987 Japan .
62-224196 10/1987 Japan .
63-190497 8/1988 Japan .

*Primary Examiner*—Michael L. Gellner
*Assistant Examiner*—Khanh Dang
*Attorney, Agent, or Firm*—Spensley Horn Jubas & Lubitz

[57] ABSTRACT

An acoustic diaphragm comprising two or more laminated composite sheets, being formed into a shape with a curved surface. The composite sheet is made up of sliced wood and nonwoven fabric cloth consisting of adhesive resin, being stuck on backside of the sliced wood. Thus, it is capable of forming a three-dimensional shape, making use of natural wood characteristics, and improving unevenness of natural material properties. In one preferred embodiment, the diaphragm is woven of slit wood or other article forming the weft and synthetic or inorganic fibers forming the warp.

7 Claims, 7 Drawing Sheets

| MATERIALS | ACOUSTIC VELOCITY $\sqrt{E/\rho}$ (m/s) | BULK SPECIFIC GRAVITY $\rho$ | ELASTICITY RATIO E (GPa) | $E/\rho^3$ ($m^8/s^2$-$kg^2$) | APPARENT INNER LOSS tan $\delta$ | $E/\rho$ |
|---|---|---|---|---|---|---|
| CONE PAPER | 2000 | 0.5～0.6 | 2 | 11～6 | 0.02 | 3.3～4 |
| PP WITH MICA | 1800 | 1.0 | 3.2 | 3.2 | 0.04 | 3.2 |
| CFRP(CLOTH) | 4000 ～5000 | 1.5 | 29 ～ 38 | 7～11 | 0.009 | 16～25.3 |
| CFRP(UD) * | 9000 ～11000 | 1.7 | 140 ～ 200 | 28～42 | 0.002 | 82～118 |
| ARAMID FIBER (CLOTH) WITH EPOXY RESIN | 4000 ～5000 | 1.2 | 19 ～ 30 | 11～17 | 0.02 | 16～25 |
| POLYETHYLENE FIBER WITH SUPER HIGH MOLECULAR WEIGHT AND EPOXY RESIN | 4000 ～4500 | 1.0 | 17 ～ 22 | 16～20 | 0.01 | 17～22 |
| SITKA SPRUCE * | 5600 | 0.4 | 12.5 | 196 | 0.006 | 31 |
| BEECH * | 4300 | 0.6 | 11.1 | 51 | 0.01 | 19 |
| JAPANESE CEDER * | 5200 | 0.4 | 10.8 | 169 | 0.006 | 27 |

* MEASURING VALUE FOR DERECTION OF FIBER (DERECTION OF STRAIGHT GRAIN IN CASE OF WOOD)

FIG.3(A)

| MATERIALS | ACOUSTIC VELOCITY $\sqrt{E/\rho}$ (m/s) | BULK SPECIFIC GRAVITY $\rho$ | ELASTICITY RATIO E (GPa) | $E/\rho^3$ ($m^8/s^2$ -$kg^2$) | APPARENT INNER LOSS tan $\delta$ | $E/\rho$ |
|---|---|---|---|---|---|---|
| SOFTENED SHEET OF SITKA SPRUCE AND NONWOVEN FABRIC CLOTH * | 3600 | 0.7 | 6.8 | 26 | 0.02 | 9.7 |
| SOFTENED SHEET OF BEECH AND EPOXY RESIN | 3450 | 1.1 | 13 | 10 | 0.04 | 12 |

* MEASURING VALUE FOR DERECTION OF FIBER (DERECTION OF STRAIGHT GRAIN IN CASE OF WOOD)

FIG.3(B)

| MATERIALS | ACOUSTIC VELOCITY $\sqrt{E/\rho}$ (m/s) | BULK SPECIFIC GRAVITY $\rho$ | ELASTICITY RATIO E (GPa) | $E/\rho^3$ ($m^8/s^2$ $-kg^2$) | APPARENT INNER LOSS tan $\delta$ | $E/\rho$ |
|---|---|---|---|---|---|---|
| SLICED ARTICLE OF SITKA SPRUCE WITHOUT SOFTENING TREATMENT AND EPOXY RESIN * | 3800 | 1.3 | 18.0 | 8.5 | 0.009 | 14 |
| SLICED ARTICLE OF BEECH WITH SOFTENING TREATMENT AND EPOXY RESIN | 3450 | 1.1 | 13 | 10 | 0.04 | 12 |

* MEASURING VALUE FOR DERECTION OF FIBER (DERECTION OF STRAIGHT GRAIN IN CASE OF WOOD)

FIG.3(C)

ACOUSTIC DIAPHRAGM

BACKGROUND OF THE INVENTION

1. Field of the Invention

The present invention relates to an acoustic diaphragm vibrated by sound signal, radiating sound in the air, and a manufacturing process for the same.

2. Background Art

There is known a conventional acoustic diaphragm (1) which consists of mixed fabric made up of two or more kinds of synthetic or inorganic fibers with high elasticity. Additionally, a conventional plate-shaped acoustic diaphragm (2) is also known, made principally of wood, natural material. The plate-shaped acoustic diaphragm (2), for example, has been manufactured by the following manufacturing process.

After wood is first sliced, the hydroxyl groups of the sliced wood are substituted with acetic groups using acetic anhydride: the suctionality of the sliced wood is thus lost, resulting in increased size stability of the sliced wood. Then, plywood is made up of the sliced wood processed as above, and formed into the above-mentioned plate-shaped acoustic diaphragm (2).

It is necessary that the above-mentioned acoustic diaphragms have the characteristics of light weight and high stiffness, namely high specific elasticity ratio ($E/\rho$) and high inner loss ($\tan \delta$) in order to display superior acoustic characteristics.

Since the above-mentioned conventional acoustic diaphragm (1) has a higher density ($\rho$) than wood, it has a lower specific elasticity ratio ($E/\rho$) than an acoustic diaphragm consisting of wood. Therefore, it is difficult to manufacture for increased stiffness a thick conventional acoustic diaphragm (1). Moreover, using for carbon fiber with high elasticity so as to manufacture the conventional acoustic diaphragm (1), it can have comparatively high specific elasticity ratio ($E/\rho$) but inner loss ($\tan \delta$) is very low. As a result, at high frequencies, innate resonated peak is sharp, thus this conventional diaphragm does not display superior acoustic characteristics.

In contrast, the above-mentioned conventional acoustic diaphragm (2) is characterized with a high specific elasticity ratio ($E/\rho$) and a superior acoustic. However, due to limitations concerning its planar plate-shape, it has the disadvantageous of that it is difficult to form curved solid shape of the conventional acoustic diaphragm (2), for example, a cone-shaped acoustic diaphragm for a speaker.

Consequently, due to increases which will occur in the production costs, the conventional processing technique cannot be applied to the manufacturing process for the conventional acoustic diaphragm (2). Moreover, due to the use of wood, natural material, material properties of the conventional acoustic diaphragm (2) as described above have the disadvantageous of being uneven and anisotropic.

SUMMARY OF THE INVENTION

In consideration of the above, it is an object of the present invention to provide an acoustic diaphragm and manufacturing process for the same, which is capable of forming a three-dimensional shape such as a shape with a curved surface, making use of characteristics of natural wood, improving unevenness of material properties of natural material, and manufacturing cheaply an acoustic diaphragm using the conventional processing technique.

So as to achieve the above stated object, the present invention provides an acoustic diaphragm comprising two or more layers of laminated composite sheets formed into a curved surface, the composite sheet being made up of sliced wood with a nonwoven fabric cloth consisting of adhesiveness resin, being stuck on backside of the sliced wood.

Moreover, the present invention provides an acoustic diaphragm comprising a combined textile formed into a shape with a curved surface, the combined textile comprising a sliced slit wood as the weft, and a synthetic or inorganic fiber as the warp.

Furthermore, the present invention provides an acoustic diaphragm comprising the combined textile formed into a shape with a curved surface, the combined textile comprising sliced slit wood pieces attached to each other as the weft and the warp.

The present invention provides a process for manufacturing an acoustic diaphragm comprising the steps of:

- slicing wood;
- sticking nonwoven fabric cloth consisting of adhesiveness resin on backside of sliced wood to produce composite sheet;
- softening the composite sheet for flexibility;
- laminating two or more sheets of the composite sheets softened; and
- pressurizing the composite sheets laminated while heating to form the acoustic diaphragm.

Moreover, the present invention provides a process for manufacturing an acoustic diaphragm comprising the steps of:

- slicing wood;
- softening the sliced wood for flexibility;
- slitting the sliced wood softened to a slit article to be fine threaded;
- combining the slit article as the weft with a synthetic or inorganic fiber as the warp;
- soaking the combined textile in thermosetting resin; and
- pressurizing the combined textile thus treated while heating to form the acoustic diaphragm.

Furthermore, the present invention provides a process for manufacturing an acoustic diaphragm comprising the steps of:

- slicing wood;
- softening the sliced wood for flexibility;
- slitting the sliced wood softened to a slit article to be fine threaded;
- combining the slit articles with each other as the weft and the warp;
- soaking the combined textile in thermosetting resin; and
- pressurizing the combined textile thus treated while heating to form the acoustic diaphragm.

With the above-mentioned acoustic diaphragm and manufacturing process for the same in accordance with the present invention, a diaphragm possessing a three-dimensional shape such as a shape with a curved surface, for example, a cone shape making use of the characteristics of natural wood, namely light weight, high stiffness, high specific elasticity ratio ($E/\rho$), and related superior acoustics can be formed. Moreover, because it is capable of using the conventional processing technique, the cost of production does not increase. Furthermore, it is capable of improving unevenness of material properties of natural material by using synthetic or inorganic fibers and by combining wood. In addition, it is capable of easily controlling the thickness of the acoustic diaphragm by properly changing the number of composite sheets laminated. It is capable of easily controlling the material properties of the acoustic diaphragm as a whole by choosing an appropriate wood base and properly changing the volume of synthetic or inorganic fiber used. Therefore, it is capable of easily designing acoustic characteristics of the acoustic diaphragm. It is capable of using superior characteristics of synthetic or inorganic fiber to the acoustic diaphragm. Because the surface of the acoustic diaphragm can be designed grain, the visual effects are large.

BRIEF EXPLANATION OF THE DRAWINGS

FIGS. 3(A), 3(B) and 3(C) are material property tables showing characteristics of materials for the acoustic diaphragm according to a first and second preferred embodiments of the present invention compared with that of a conventional acoustic diaphragm.

DETAILED DESCRIPTION OF THE PREFERRED EMBODIMENTS

FIRST EMBODIMENT

Figure 1A:
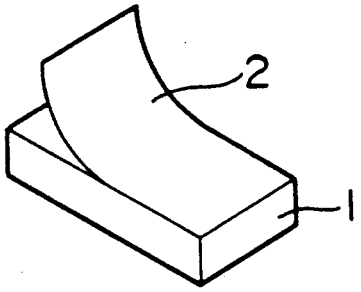
FIGS. 1(A), 1(B), 1(C) and 1(D) are diagrams showing a manufacturing process for an acoustic diaphragm according to the first preferred embodiment of the present invention.
Figure 1B:
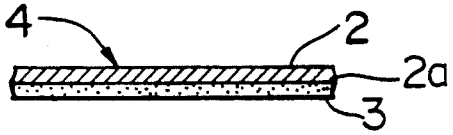
Figure 1C:
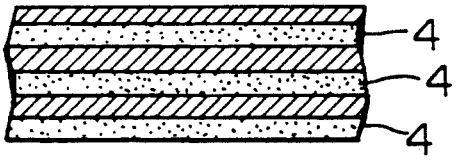
Figure 1D:
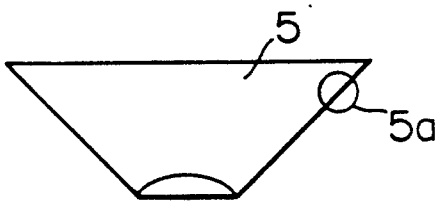

Hereinafter, an explanation of a first preferred embodiment of the present invention will be given with reference to the figures. FIG. 1 shows a manufacturing process for an acoustic diaphragm according to the first preferred embodiment of the present invention. In the following, this manufacturing process is explained in order.

PROCESS (1)

The wood 1 is sliced into sheets 2 of 20–80 μm in thickness as shown in FIG. 1 (A). It is exceedingly fit to use Sitka spruce as the above-mentioned wood 1 in consideration of its material property. Moreover, it is possible to use silver fir, Japanese cedar or beech and the like for the wood 1.

PROCESS (2)

Nonwoven fabric cloth 3 consisting of adhesiveness resin, is stuck on backside of the sheet 2 to produce composite sheet 4 as shown in FIG. 1 (B). Thermoplastic resin such as polypropylene or polyethylene, for example, can be used as the adhesiveness resin. Next, the composite sheet 4 is softened by chemical treatment to provide flexibility. As the chemical treatment, the following treatment can be employed.

The composite sheet 4 is first soaked for 10 to 15 minutes in softening agent heated at 20°–80° C. Then, the composite sheet 4 thus treated is heated for a few minutes at about 50° C. to polymerize the softening agent. A treatment liquid made up of a water-based emulsion of urethane as the main element with natural material, for example, can be used as the softening agent described above.

PROCESS (3)

Two or more sheets of the composite sheets 4 thus treated for flexibility, are laminated as shown in FIG. 1 (C) and are set in a desired die.

PROCESS (4)

Figure 2:
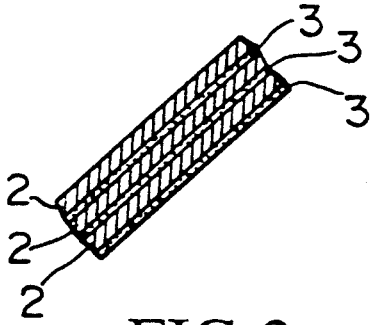
FIG. 2 is a cross sectional view showing a magnified part $5_a$ of the acoustic diaphragm 5 shown in FIG. 1 (D).

The composite sheets 4 set in the desired die, are pressurized while heating to form an acoustic diaphragm 5 possessing a cone shape as shown in FIG. 1 (D). For example, in the case of using a nonwoven fabric cloth 3 consisting of polypropylene, the composite sheets 4 set in the desired die, are appropriately pressurized at 10–50 kg/cm$^2$ while heating at 170°–200° C. FIG. 2 is a cross sectional view showing a magnified part $5_a$ of the acoustic diaphragm 5 shown in FIG. 1 (D).

FIG. 3 is a material property table showing characteristics of materials for the conventional acoustic diaphragm (see FIG. 3 (A)) and the first preferred embodiment of the present invention (see FIG. 3 (B)). In FIG. 3, both an acoustic velocity $(E/\rho)^{\frac{1}{2}}$ and an apparent inner loss (tan δ) were measured by employing a bending resonance method.

As shown by FIG. 3, the acoustic diaphragm 5 according to the first preferred embodiment of the present invention has the characteristics of high specific elasticity ratio ($E/\rho$) and superior acoustic characteristics.

In the first preferred embodiment of the present invention, the reason for slicing the wood 1 into sheet 2 to a thickness of 20–80 μm will be described below. If the sheet 2 is too thick, it is difficult to generally form the composite sheets 4 into a curved surface shape as well as to make the softening agent sufficiently permeate the sheet 2 in treating it for flexibility. Therefore, 80 μm is the maximum allowable upper limit of the sheet 2 in accordance with present condition of the wood permeating treatment for flexibility.

In contrast, if the sheet 2 is too thin, mechanical intensity of the composite sheet 4 itself decreases, and thus the composite sheet 4 is likely to crack when forming. The lower limit of the sheet 2 is 20 μm is due to this being the lower limit of the present slicer.

Figure 4:
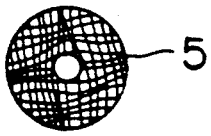
FIG. 4 shows a process for laminating composite sheets 4 according to the first preferred embodiment of the present invention.
Figure 5:
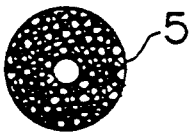
FIG. 5 shows another process for laminating composite sheets 4 according to the first preferred embodiment of the present invention.
Figure 6A:
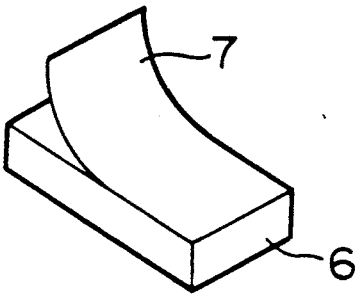
FIGS. 6(A), 6(B), 6(C) and 6(D) are diagrams showing a manufacturing process for an acoustic diaphragm according to a second preferred embodiment of the present invention.
Figure 6B:
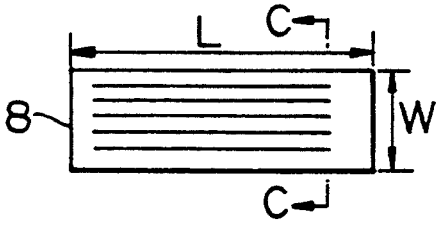
Figure 6C:
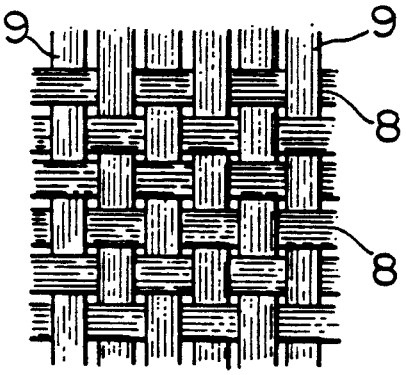
Figure 6D:
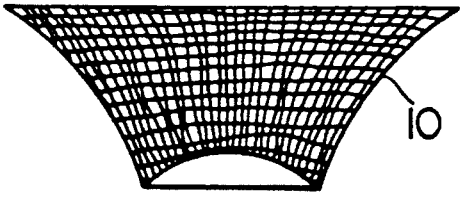

Furthermore, in case where the composite sheets 4 are laminated in PROCESS (3) of the above described first preferred embodiment of the present invention, to increase the mechanical intensity of the composite sheets 4, the lamination should be carried out so that wood fabric of the composite sheets 4 crosses at right angles as shown in FIG. 4. Moreover, to obtain isotropic material properties, such as tension and bent elasticity ratio being equal in all directions in the acoustic diaphragm, the composite sheets 4 should be laminated so that their wood fabrics cross at right and 45 degrees angles as shown in FIG. 5.

Moreover, in case where the composite sheets 4 are laminated in PROCESS (3) of the first preferred embodiment of the present invention described above, [he number of laminated composite sheets 4, that is, thickness and weight of the acoustic diaphragm 5 is determined based on system designed in consideration of acoustic characteristics and density of wood 1. Assuming that the acoustic diaphragm 5 of the first preferred embodiment of the present invention is a kind of composite material, reducing the amount of resin to permissible limits and laminating woods 1 as much as possible, cause improvement of material values such as specific elasticity ratio ($E/\rho$), and thus improvement in acoustic characteristics, namely tone quality.

SECOND EMBODIMENT

Next, an explanation of a second preferred embodiment of the present invention will be given with reference to the figures. FIG. 6 is process showing manufacturing process for an acoustic diaphragm according to the second preferred embodiment of the present invention. In the following, this manufacturing process is explained in order.

PROCESS (1)

The wood 6 is sliced into sheets 7 with a thickness of 20–80 μm as shown in FIG. 6 (A). It is exceedingly fit to use Sitka spruce as the above-mentioned wood 6 in consideration of its material property. Moreover, it is also possible to use silver fir, Japanese cedar or beech and the like for the wood 6. Next, the sheet 7 is softened by a chemical treatment to provide flexibility.

The chemical treatment, for example, can be as follows. The sheet 7 is initially soaked for 10 to 15 minutes in softening agent heated at 20°–80° C. Then, the sheet 7 thus treated is heated for a few minutes at about 50° C. to polymerize the softening agent. A treatment liquid made up of a water-based emulsion of urethane as the main element with natural material, for example, can be used for the softening agent described above.

PROCESS (2)

Figure 7:
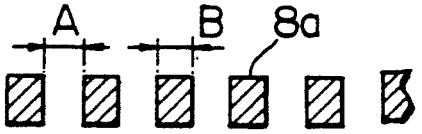
FIG. 7 is a cross sectional view taken along the lines C—C, showing a magnified part of the slit article 8 shown in FIG. 6 (B).
Figure 8A:
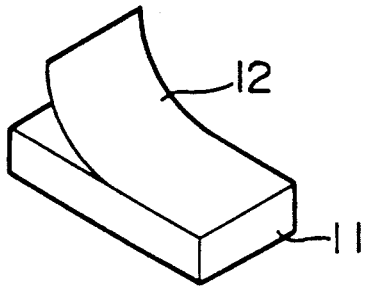
FIGS. 8(A), 8(B), 8(C) and 8(D) show a manufacturing process for an acoustic diaphragm according to a third preferred embodiment of the present invention.
Figure 8B:
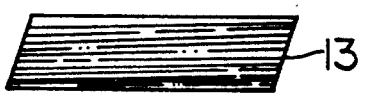
Figure 8C:
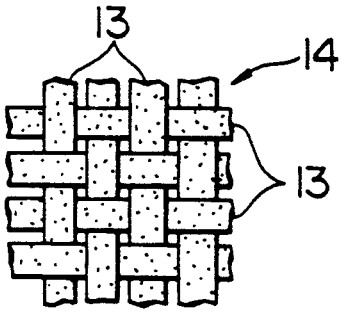
Figure 8D:
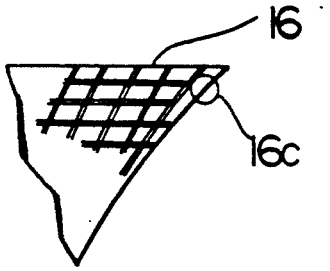

Both ends of the sheet 7 thus treated are fixed using such as a paper streamer, and the sheet 7 is slit to a slit article 8 to be fine threaded in the range of 0.6–1.0 mm using a cutting machine as shown in FIG. 6 (B). In this second preferred embodiment of the present invention, the slit article 8 is 120 mm in width W and less than 900 mm in length L. FIG. 7 is a cross section taken along the line C—C, showing a magnified part of the slit article 8 shown in FIG. 6 (B). In this preferred embodiment of the present invention, the slit pitch A is nearly equal to the width B of a slit wood 8*a*.

PROCESS (3)

As shown in FIG. 6 (C), the slit article 8 described above as the weft is combined using a loom with existing synthetic or inorganic fibers 9 which can be regarded as the warp. As the synthetic or the inorganic fiber, polyethylene fiber, aramid fiber, polyallylate fiber, carbon fiber and the like can be used.

PROCESS (4)

The combined textile is soaked in thermosetting resin and is set in a desired die. The combined textile thus treated, are pressurized while heating at about 100° C. to form a cone-shaped acoustic diaphragm 10 as shown in FIG. 6 (D).

In FIG. 3 (C), shows characteristics of possible materials for the acoustic diaphragm of the second preferred embodiment of the present invention. As shown by FIG. 3, the acoustic diaphragm 10 of the second preferred embodiment of the present invention has a higher elasticity ratio E and a lower specific gravity $\rho$ than the conventional acoustic diaphragm. Consequently, specific elasticity ratio ($E/\rho$), sound velocity $(E/\rho)^{\frac{1}{2}}$ and ($E/\rho^3$) of the acoustic diaphragm 10 based on characteristics as described above, are all higher than the conventional acoustic diaphragm. Moreover, bent stiffness E·I of the acoustic diaphragm 10 is larger than that of conventional acoustic diaphragm. The formability of acoustic diaphragm 10 is greater than that of conventional acoustic diaphragms, however this fact is not shown in FIG. 3. The reason for this is the following. Since an inertia moment E is in proportion to cube of thickness, if the respective weights of the acoustic diaphragm 10 and the conventional acoustic diaphragm are equal, the acoustic diaphragm 10, the lower the specific gravity $\rho$, the greater the thickness of formation. Therefore, the acoustic diaphragm 10 is more advantageous than the conventional acoustic diaphragm.

For that reason, since the acoustic diaphragm 10 of the second preferred embodiment of the present invention has superior acoustic characteristics over thoseof the conventional acoustic diaphragm, its sound quality is also improved in comparison. Moreover, when selecting material such as wood 6 and synthetic or inorganic fiber 9, the above-mentioned conditions are optimized, thus material properties of the acoustic diaphragm 10 according to the second preferred embodiment of the present invention, namely elasticity ratio E, specific gravity $\rho$ and inner loss (tan $\delta$) will be improved to a greater extent than described above.

In the second preferred embodiment of the present invention, the reason for slicing the wood 6 into sheets 7 with a thickness of 20–80 μm will be described below. If the sheet 6 is too thick, it is generally difficult to form the combined textile into the shape with a curved surface as well as the softening agent cannot sufficiently permeate the sheet 7 in the treatment for flexibility. Therefore, the condition which the sheet 7 should be thinner than 80 μm is allowable upper limit in the present condition of permeating as PROCESS (4).

In contrast, if the sheet 7 is too thin, mechanical intensity of the slit article 8 itself decreases, and the slit article 8 is likely to crack during formation. The condition which the sheet 7 is thicker than 20 μm is because it is lower limit in the present slicer.

Furthermore, in PROCESS (2) in the second preferred embodiment of the present invention described above, it is shown that the slit pitch A is nearly equal to the width B of a slit wood 8*a*. However, the condition of the present invention is not limited to just that described above. For example, in order to accentuate visual grain, the slit pitch A should be made smaller than the width B of a slit wood 8*a*. In contrast, to improve the material property of the acoustic diaphragm 10, the slit pitch A should be made wider than width B of a slit wood 8a, and more synthetic or inorganic fiber 9 should be used.

Moreover, in the PROCESS (2) in the second preferred embodiment of the present invention described above, it is shown that the slit article 8 is 120 mm in width W and less than 900 mm in length L. However, the condition of the present invention is not limited to just that described above. In other words, since the width and the length of the slit article 8 can cover area of the acoustic diaphragm to be formed, the slit article 8 can fundamentally be any size: it is also permissible for some sheets of the slit article 8 to be attached to each other widthwise to form the acoustic diaphragm 10. In addition, in the second preferred embodiment of the present invention described above, it is capable of easily controlling the various material properties described above of the acoustic diaphragm 10 as a whole by appropriately choosing the wood base and properly changing the volume of synthetic or inorganic fiber 9 used.

THIRD EMBODIMENT

Next, an explanation of a third preferred embodiment of the present invention is given with reference to the figures. FIG. 8 is process showing manufacturing process for an acoustic diaphragm of the third preferred embodiment of the present invention. In the following, that manufacturing process is explained in order.

PROCESS (1)

The wood 11 is sliced into sheets 12 of thickness of 20–80 μm as shown in FIG. 8 (A). It is exceedingly fit to use Sitka spruce as the above-mentioned wood 11 in consideration of its material property. Moreover, silver fir, Japanese cedar or beech and the like can also be used as wood 11. Next, the sheet 12 is softened by chemical treatment for flexibility. The chemical treatment, for example, can be as follows. The sheet 12 is initially soaked for 10 to 15 minutes in softening agent heated at 20°–80° C. After which, the treated sheet 12 is heated for a few minutes at about 50° C. to polymerize the softening agent. The treating liquid made up of blending water based emulsion of urethane as main element with natural material, for example, can be used for the softening agent described above.

PROCESS (2)

Both ends of the sheet 12 thus treated are fixed using such a paper streamer and the sheet 12 is slit to a slit article 13 to be fine threaded to the extent of 0.6–1.0 mm using a cutting machine as shown in FIG. 8 (B). In this preferred embodiment of the present invention, the slit article 13 is 120 mm in width W and less than 900 mm in length L.

PROCESS (3)

As shown in FIG. 8 (C), two sheets of the slit article 13 described above are combined using a loom with each other as the weft and the warp.

PROCESS (4)

Figure 9:
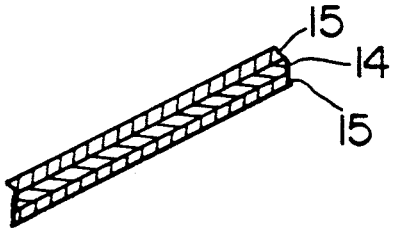
FIG. 9 is a cross sectional view showing a magnified part $16_a$ of the acoustic diaphragm 16 shown in FIG. 8 (D).

The combined textile 14 is soaked in thermosetting resin 15 and is set in a desired die. The combined textile 14 thus treated and set, is then pressurized while heating at about 100° C. to form an acoustic diaphragm 16 with a cone shape as shown in FIG. 8 (D). FIG. 9 is a cross section showing a magnified part $16_a$ of the acoustic diaphragm 16 shown in FIG. 8 (D).

As explaining above, the acoustic diaphragm 16 of the third preferred embodiment of the present invention has a higher elasticity ratio E and a lower specific gravity $\rho$ than the conventional acoustic diaphragm. Consequently, specific elasticity ratio ($E/\rho$), sound velocity $(E/\rho)^{\frac{1}{2}}$ and ($E/\rho^3$) of the acoustic diaphragm 16 based on characteristics as described above, are all higher than the conventional acoustic diaphragm. Moreover, bent stiffness E·I of the acoustic diaphragm 16 is larger than the conventional acoustic diaphragm, formability of the acoustic diaphragm 16 being better than that of the conventional acoustic diaphragm. The reason for this is the following. Since an inertia moment E is in proportion to the cube of thickness, if the respective weights of the acoustic diaphragm 16 and the conventional acoustic diaphragm are equal, the lower specific gravity $\rho$ of the acoustic diaphragm 16, the greater the thickness formed. Therefore, the acoustic diaphragm 16 is more advantageous than the conventional acoustic diaphragm.

For that reason, since the acoustic diaphragm 16 of the third preferred embodiment of the present invention is superior acoustic characteristics than the conventional acoustic diaphragm, sound quality is improved in comparison with the conventional acoustic diaphragm. Moreover, when selecting material such as wood 11 and optimizing the above-mentioned conditions, material property of the acoustic diaphragm 16 of the third preferred embodiment of the present invention, namely elasticity ratio E, specific gravity $\rho$ and inner loss (tan $\delta$) will be improved greater extent than described above.

In the third preferred embodiment of the present invention, the reason for slicing wood 11 into sheets 12 to the extent of 20–80 μm in thickness, is similar to the reason in the first preferred embodiment of the present invention.

Moreover, in the PROCESS (2) in the third preferred embodiment described above of the present invention, it is shown that the slit article 13 is 120 mm in width W and less than 900 mm in length L. However, the condition of the present invention is not limited to just that described above. In other words, since the width and the length of the slit article 13 can cover area of the acoustic diaphragm to be formed, the slit article 13 can fundamentally be any size: it is also permissible for some sheets of the slit article 13 to be attached to each other widthwise to form the acoustic diaphragm 16.

What is claimed is:

1. An acoustic diaphragm comprising a combined textile formed into a shape with a curved surface, wherein said combined textile comprises weft elements interwoven with warp elements, the weft elements being comprised of sliced slit wood and the ward elements being comprised of synthetic fiber.

2. An acoustic diaphragm comprising a combined textile formed into a shape with a curved surface, wherein said combined textile comprises weft elements interwoven with warp elements, the weft elements being comprised of sliced slit wood and the warp elements being comprised of inorganic fiber as the warp.

3. An acoustic diaphragm according to claim 1, wherein said sliced slit wood includes Sitka spruce, silver fir, Japanese cedar, and beech.

4. An acoustic diaphragm according to claim 1, wherein said sliced slit wood is comprised of sheets having a thickness of 20–80 μm.

5. An acoustic diaphragm according to claim 1, wherein said synthetic fiber is selected from a group consisting of polyethylene fiber, aramid fiber, polyallylate fiber and carbon fiber.

6. An acoustic diaphragm according to claim 2, wherein said inorganic fiber is selected from a group consisting of polyethylene fiber, aramid fiber, polyallylate fiber, and carbon fiber.

7. An acoustic diaphragm comprising a combined textile formed into a shape with a curved surface, wherein said combined textile comprises weft elements interwoven with warp elements and sliced slit wood elements are used as at least one of the weft and the warp elements.

* * * * *